US012704314B2

(12) United States Patent
Nieuwlaat et al.

(10) Patent No.: US 12,704,314 B2
(45) Date of Patent: Aug. 11, 2026

(54) SUPPORT BEAM FOR A REFRIGERATOR

(71) Applicant: ILLINOIS TOOL WORKS INC., Glenview, IL (US)

(72) Inventors: Jos Nieuwlaat, Etten-Leur (NL); Joannes Sebastiaan Cornelis Emmen, Etten-Leur (NL); Thijs Slagter, Etten-Leur (NL)

(73) Assignee: ILLINOIS TOOL WORKS INC., Glenview, IL (US)

( * ) Notice: Subject to any disclaimer, the term of this patent is extended or adjusted under 35 U.S.C. 154(b) by 108 days.

(21) Appl. No.: 18/777,642

(22) Filed: Jul. 19, 2024

(65) Prior Publication Data

US 2025/0027707 A1 Jan. 23, 2025

(30) Foreign Application Priority Data

Jul. 19, 2023 (GB) ..... 2311022

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 2323/02* (2013.01)

(58) Field of Classification Search
CPC ..... F25D 23/028; F25D 23/06; F25D 27/00; F25D 2323/02; F25D 2323/021; F25D 2400/04; F25D 2400/06
See application file for complete search history.

(56) References Cited

U.S. PATENT DOCUMENTS 5,349,832 A * 9/1994 Johnson ..... E05D 5/06 62/272
6,266,970 B1 * 7/2001 Nam ..... F25D 23/028 62/277
2004/0189165 A1 * 9/2004 An ..... E05C 19/161 312/405
2011/0304253 A1 * 12/2011 Howington ..... F25D 27/00 312/405
2013/0285517 A1 * 10/2013 Wach ..... A47F 3/043 49/504
2015/0107084 A1 * 4/2015 Craycraft ..... E05D 5/046 29/505
2019/0059613 A1 * 2/2019 Artwohl ..... E05D 5/0246
2022/0372811 A1 * 11/2022 Gomez ..... A47F 3/043
2024/0011698 A1 * 1/2024 Junge ..... F25D 21/04

FOREIGN PATENT DOCUMENTS

JP H02259384 A 10/1990
WO 2013060417 A2 5/2013
WO 2013163533 A2 10/2013

* cited by examiner

*Primary Examiner* — Daniel J Rohrhoff
(74) *Attorney, Agent, or Firm* — THOMPSON HINE LLP

(57) ABSTRACT

A support beam for a refrigerator includes an outer shell defining a cavity, or a spine with a keyed surface, a filler applied to the outer shell or spine, and at least one jamb. The filler and outer shell or spine are formed of the same material. A method of manufacture, a fridge including the support and a kit are also described.

14 Claims, 3 Drawing Sheets

SUPPORT BEAM FOR A REFRIGERATOR

TECHNICAL FIELD

The invention relates generally to a support beam for a refrigerator.

BACKGROUND

Refrigerators (FIG. 1, prior art, 100) are commonly used to store products such as food and beverages. Different refrigerators 100 vary in size depending on refrigerator capacity, the size of the housing, number of shelves and the volume of the enclosure for storing products.

The manufacture of refrigerators 100 can be complex requiring the use of multiple materials, such as metals, plastics, and composites. Particularly with respect to structural components that are exposed internally in the refrigerator 100. Such components must possess the necessary rigidity and strength to provide structural functions including maintaining the external shape of the refrigerator 100 while doors are opened/shut to access the refrigerator 100, and also to support further internal items, such as shelving and any contents loaded thereon.

The structural components, when exposed internally, must also be adapted to cope with the reduced temperature environment of the inside of a refrigerator 100 and may be exposed to condensation, and be capable of being cleaned. Bearing in mind that refrigerators may be used to store food and drink stuffs, materials selected must be appropriate so as to not taint any contents of the refrigerator 100.

Prior art methods, with reference to FIG. 2, involve coating a metal strut 200 with plastic 201 to provide the necessary combination of features. However, the thermal conductivity of metal is problematic as it can reduce the operating efficiency of the refrigerator 100, as well as providing a surface on which condensation may form. Once the refrigerator 100 is at the end of its useful life, recycling of the support is problematic due to the combination of materials used and the energy intensive process required to separate them.

SUMMARY

In accordance with a first example of the disclosure there is provided a support beam for a refrigerator, the support beam comprising: an outer shell defining a cavity, a filler occupying the cavity, at least one jamb, formed by the outer shell, wherein the filler and outer shell are formed of the same material. Advantageously, the use of a single material means that the support beam may be easily recycled at the end of its useful life. The use of a filler, particularly a foam or other cellular structure, provides enhanced insulation and reduced thermal conductivity, and the rigid outer shell provides the required structure and rigidity for the support beam to function supporting the external structure of the fridge and any shelves and contents attached thereto.

In a second example of the disclosure there is provided a support beam for a refrigerator, the support beam comprising: a rigid spine comprising a keyed surface, a filler at least partially coating the spine, and engaged with the keyed surface, at least one jamb, formed by the filler, wherein the filler and the spine are formed of the same material. Advantageously, the use of a single material means that the support beam may be easily recycled at the end of its useful life. The use of a filler, particularly a foam or other cellular structure, provides enhanced insulation and reduced thermal conductivity, and the rigid outer shell provides the required structure and rigidity for the support beam to function supporting the external structure of the fridge and any shelves and contents attached thereto.

The following optional features presented up to paragraph are compatible with either of the first of second examples of the disclosure.

Suitably, the material is a polymer, optionally the polymer is polypropylene. Polymers provide excellent thermal properties and are suitable for use in refrigerators which often store food and drink stuffs without the risk of tainting the contents.

Preferably, the filler is a foam, optionally wherein the foam comprises expanded polypropylene. Use of a foam provides enhanced thermal properties due to the poor conductivity of the gas trapped in the cells of the foam. An open or closed cellular structure foam may be used. Foams are also light weight, reducing the overall weight of the refrigerator when installed.

Suitably, the outer shell or spine is a single piece, optionally formed by extrusion, and further optionally wherein the outer shell or spine are formed by extrusion of polypropylene. Using a single piece construction or a single material reduces manufacturing cost, time and complexity, as well as improving case of recycling at end of life.

Optionally, the support beam comprises two jambs, each arranged to abut first and second respective doors. Jambs are part of the frame into which a door locates when the door is in the shut position. The support beams disclosed herein may be used in a multi-door refrigerator, and placed between two adjacent doors, thereby forming part of the frame for each door to close, and thereby providing a jamb for each respective door.

Preferably, the two jambs are arranged on different faces of the support beam in order to allow separate doors to be placed in a closed position, and abutting the jambs of the support beam.

Suitably, the support beam is a barrier to thermal conductivity between the interior of a refrigerator and the exterior of a refrigerator, thereby reducing the risk of condensation forming and improving the efficiency of the refrigerator by reducing the transmission of heat into refrigerator.

Optionally, when in use, the support beam provides a closing face to a door of a refrigerator, so no further components are required to form the door frame where a support beam is used.

Preferably, the support beam comprises a door sealing surface, optionally an air-tight door sealing surface. In this way no further seals are required other than the surface of the support beam. Including a sealing surface is beneficial with respect to the efficiency of the refrigerator preventing the escape of the cool air inside.

Suitably, the support beam comprises an ancillary component mount optionally formed in the filler or outer shell. In this way the support beam can provide a further purpose in providing a mount of other useful elements of the refrigerator, including, by way of non-limitative example, shelving and/or lighting.

Optionally, an ancillary component is at least temporarily fixed to the ancillary component mount, and optionally wherein the ancillary component is a light, further optionally a light strip, and still more optionally an LED light strip. Allowing the ancillary component to be temporarily fixed allows the component to be removed, serviced, or replaced required. Arranging a light on the support beam is advantageous as, where the support beam is in the centre of the refrigerator, the positioning of the light is optimal for illuminating the internals of the refrigerator without casting glare outside.

Preferably, the support beam further comprises means to urge a door in contact with the support beam towards the support beam, optionally wherein the urging means is a magnet or ferromagnetic strip. The urging means ensure a door remains in a closed position. The strength of the urging means should not be such that an operator cannot open the door, but that an intentional effort is required by the operator to open the door and overcome the urging means. This is to prevent accidental opening of the door. The urging means may also operate when the door is in a nearly closed position, such that the door is proximate the jamb, but not touching the jamb. In this way, the urging means may pull the door into the closed position thereby ensuring an effective closure of the door, for example, if an operator accidentally closes a door with insufficient force to fully move the door into the closed position.

Optionally, the support beam is capable of bearing the load of one or more refrigerator shelves and/or a refrigerator top panel. The support beam alone is therefore capable of bearing the load of any contents arranged upon one or more shelves of the refrigerator as well as capable of supporting the external walls, such as the top panel.

Suitably, the support beam is provided with one or more accessible fixings to at least temporarily connect the support beam to a refrigerator, and optionally wherein the one or more accessible fixings are tool-less fixings. The support beam is locatable in position in the refrigerator without requiring any disassembly, whether partial or full, of the refrigerator prior to fitting the support beam in position. As such, the fixing means should be accessible to a person without any disassembly of the refrigerator. The fixings may be a conventional flange and screw or bolt or any other suitable fixing requiring a tool. Alternatively the fixings may be tool-less allowing a user to position and fix the support beam in place with nothing more than their hands. Example tool-less fixings include snap fit, bayonet fixings, and the like.

In a third example of the present disclosure there is provided a method of manufacturing a support beam as claimed in either the first or second examples of the disclosure, the method comprising extruding an outer shell or a spine, and applying a filler to the cavity of the outer shell or the keyed surface of the spine, such that the filler adheres to the outer shell or spine.

In a fourth example of the present disclosure there is provided a refrigerator comprising a support beam as described in the first or second examples of the disclosure, or as made using the method of the third example of the disclosure.

In a fifth example of the disclosure there is provided a kit of parts comprising a support beam as described in the first or second examples of the disclosure, or as made using the method of the third example of the disclosure.

BRIEF DESCRIPTION OF THE DRAWINGS

Embodiments of the invention are now described, by way of example only, hereinafter with reference to the accompanying drawings, in which.

DETAILED DESCRIPTION

Figure 1:
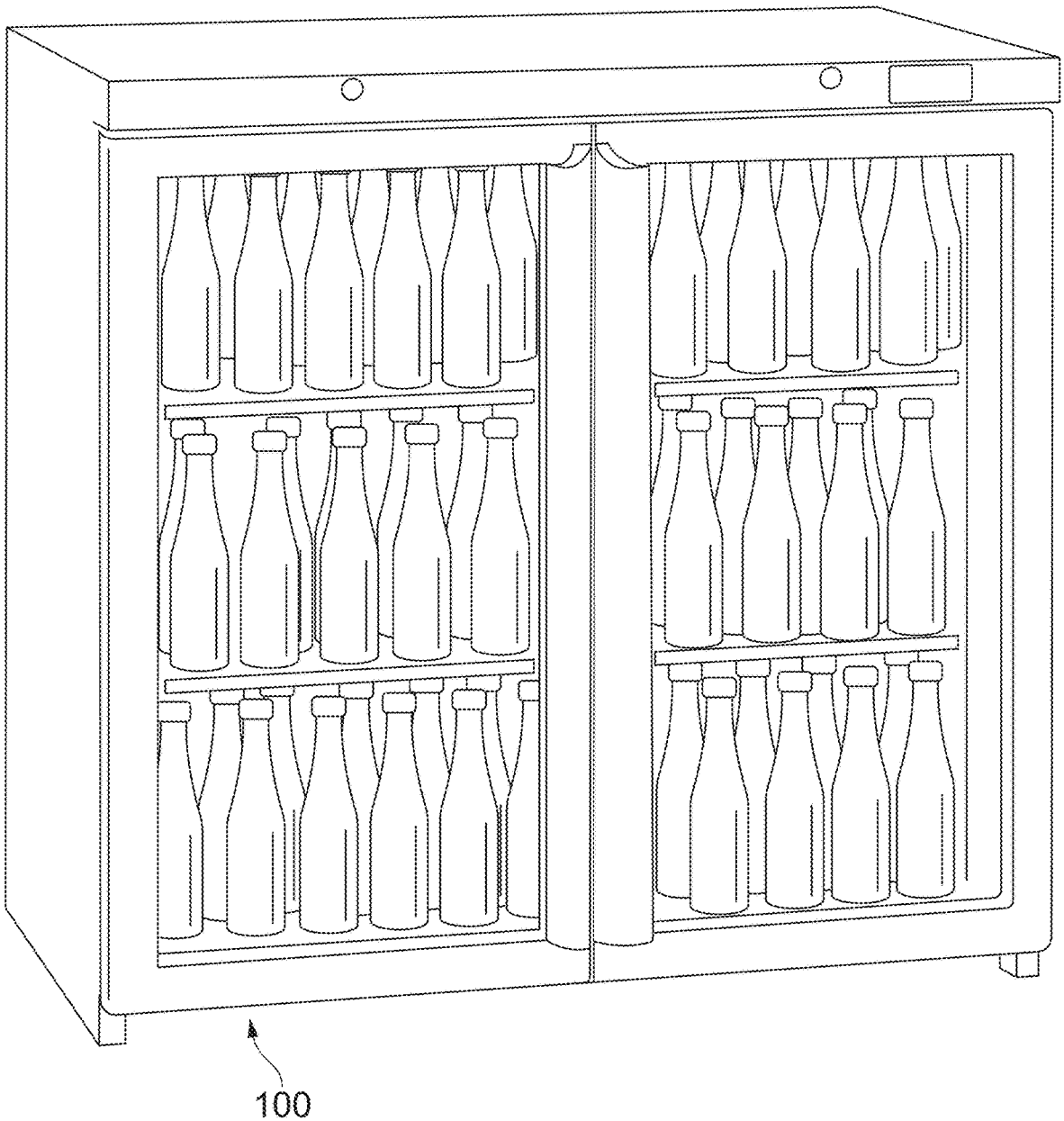
FIG. 1 (Prior Art)
FIG. 1 illustrates a refrigerator.

Certain terminology is used in the following description for convenience only and is not limiting. The words 'right', 'left', 'lower', 'upper', 'front', 'rear', 'upward', 'down' and 'downward' designate directions in the drawings to which reference is made and are with respect to the described component when assembled and mounted. The words 'inner', 'inwardly' and 'outer', 'outwardly' refer to directions toward and away from, respectively, a designated centreline or a geometric centre of an element being described (e.g. central axis), the particular meaning being readily apparent from the context of the description.

Further, as used herein, the terms 'connected', 'attached', 'coupled', 'mounted' are intended to include direct connections between two members without any other members interposed therebetween, as well as, indirect connections between members in which one or more other members are interposed therebetween. The terminology includes the words specifically mentioned above, derivatives thereof, and words of similar import.

Further, unless otherwise specified, the use of ordinal adjectives, such as, "first", "second", "third" etc. merely indicate that different instances of like objects are being referred to and are not intended to imply that the objects so described must be in a given sequence, either temporally, spatially, in ranking or in any other manner.

Like reference numerals are used to depict like features throughout.

Figure 3:
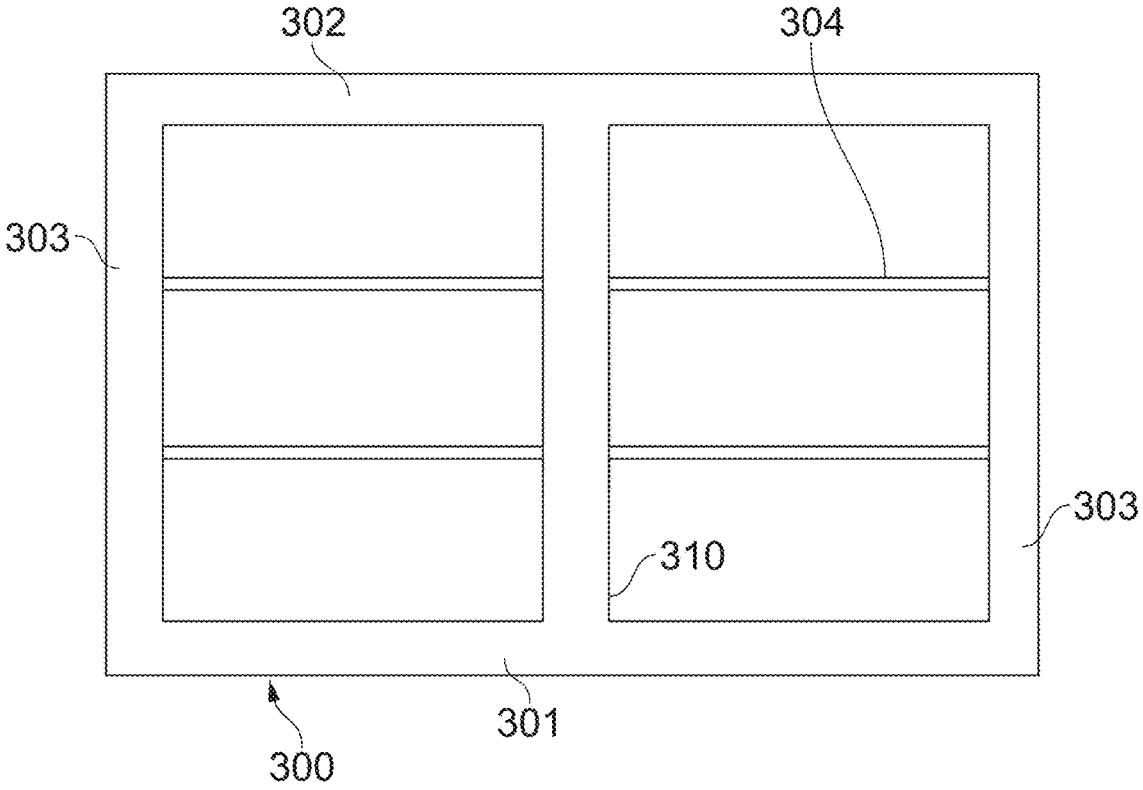
FIG. 3 shows an internal cross section of a refrigerator comprising a support beam.

FIG. 3 shows an internal cross section of a refrigerator 300. The refrigerator 300 is made up of a base panel 301, top panel 302, pair of side panels 303, and a rear panel (not shown). A support beam 310 is provided at a point between the pair of side panels to provide additional support between the base panel 301 and top panel 302. It will be apparent that the support beam 310 may be placed at any point between the two side panels 303, and need not be equidistant, and that multiple support beams 310 may be provided at any interval between the two side panels 303.

The support beam 310 may be removable from its position in the refrigerator 300, in this way the support beam 310 may be retrofittable to existing refrigerators, provided the support beam 310 has compatible connectors with the existing fittings of the refrigerator 300, or if the refrigerator 300 may be provided with suitable adaptors to accept the support beam 310. It may be desirable to retrofit the support beam 310, replacing a prior art beam such as that shown in FIG. 2 to improve the thermal properties of the refrigerator 300, or if the prior art beam has started to rust or degrade. Suitable connectors may be a flange provided on either the refrigerator 300 or the support beam 310 and corresponding apertures on the receiving surface, which may be threaded to accept a bolt, although it will be apparent that any suitable mechanical connection may be used. Alternatively, tool-less fixings may be used to allow the support beam 310 to be simply clipped into place, preferably reversibly.

Alternatively, the support beam 310 may be integrally constructed with the refrigerator 300.

A plurality of shelves 304 are provided spanning a gap between the support beam 310 and the side panels 303. Where multiple support beams 310 are used shelves 304 may span the gap between two adjacent support beams 310 and no side panel is required to support such a shelf 304. The shelves 304 may, or may not, be attached to the rear panel.

Figure 4:
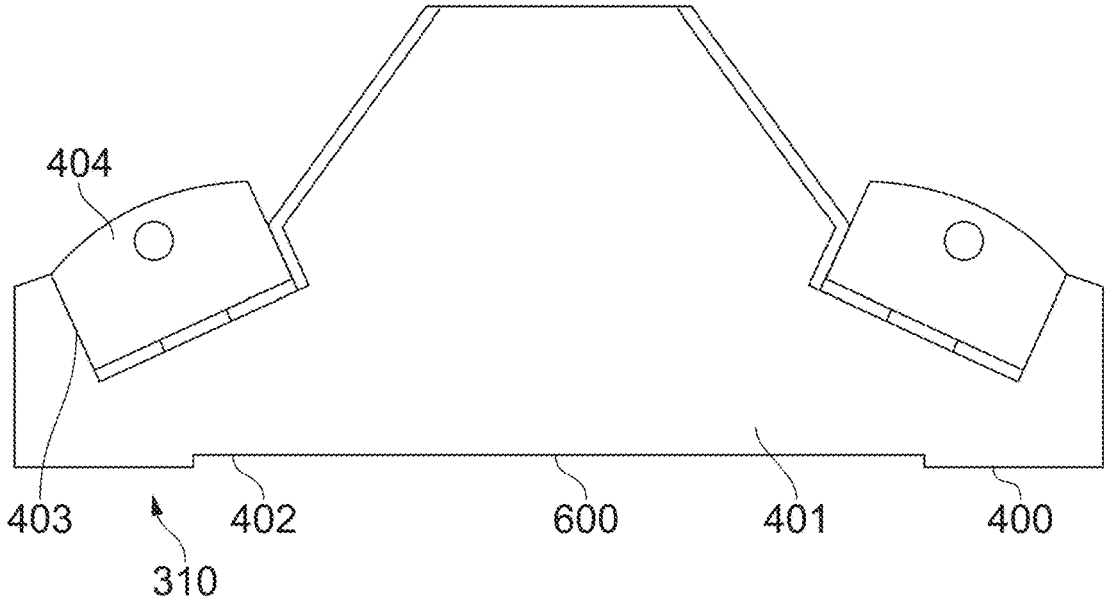
FIG. 4 shows a cross section of a support beam according to the first example of the disclosure.

FIG. 4 shows a cross section of a support beam 310 according to a first example of the disclosure. The support beam 310 comprises an outer shell 400, which in this case is made from extruded polypropylene, thereby forming a cavity. The cross section of the outer shell 400 is approximately that of an irregular hexagon, with one side substantially longer than the others. The longer side forming a jamb 402 to receive at least one door. Extending the length allows the single surface to receive two doors. Provided the surface is suitable smooth then a seal arranged on the door may provide an air-tight seal when the door is in the closed position abutting the jamb 402.

Other suitable cross sections can be envisioned, the minimum requirements for such are to provide a cavity, and at least one jamb 402 to receive a door.

The cavity may be fully enclosed or partially. Where an enclosed cavity is used at least one aperture must be provided during manufacture to allow the insertion of the filler. The aperture may be sealed following insertion of the filler to provide an enclosed cavity.

The in inclusion of ancillary components 404, such as the LED light strips shown in FIG. 4 may necessitate other cross-sectional shapes.

Here the ancillary components 404 are located in a recess, or ancillary component mount 403, of the surface of the outer shell 400, such that the ancillary component 404 sits approximately flush with the surface of the outer shell 400, or at least such as to minimise the internal volume of the refrigerator 300 occupied by the ancillary components 404. The ancillary components 404 are typically lights, preferably light strips, which run along a length of the support beam 310. Suitable light strips include LED light strips although other types of light strips may be used. A light strip is advantageous in that light is produced along the full length of the light strip, in this way the full height of the refrigerator 300 may be lit up by a light strip running the full length of the support beam 310 (the length of the support beam 310 corresponding to the internal height of the refrigerator 300).

Preferably, the light strips are arranged at an angle, such that light emanating from the light strips is directed towards the rear of the refrigerator 300, this ensures that the contents inside the refrigerator 300 are adequately lit up and also avoids light escaping from the front of the refrigerator 300, where doors with windows are used, thereby minimising glare to a user of the refrigerator 300. This ensures contents are easy to identify.

It is possible that the main length of the support beam 310 need not be arranged perpendicular to the top 302 and base plates 301 nor parallel to the side walls 303. The support beam 310 could be arranged at an angle, for example to provide a novel design of refrigerator 300 or to provide a cross brace function.

Power may be run to the ancillary components 404 via the refrigerator top 302 or base plates 301. While it is possible for services, such as power, to run through the support beam 310 this may increase the complexity of recycling the support beam 310 in future due to the mixture of different materials.

The cavity of the outer shell 400 is filled with a polypropylene foam, although any compatible material may be used. The point is that the filler 401 material should be the same, or compatible/complementary, from a recycling perspective, to the material used for the outer shell 400. This should also minimise manufacturing complexity. A foam is preferable due to its insulating properties. A closed cell foam may be beneficial as such foams are non-absorbent, therefore should the outer shell 400 ever become cracked or otherwise compromised, ingress of contaminants into the cavity will be minimised. That said, an open cell foam structure may be used if required, and is not excluded.

Figure 2:
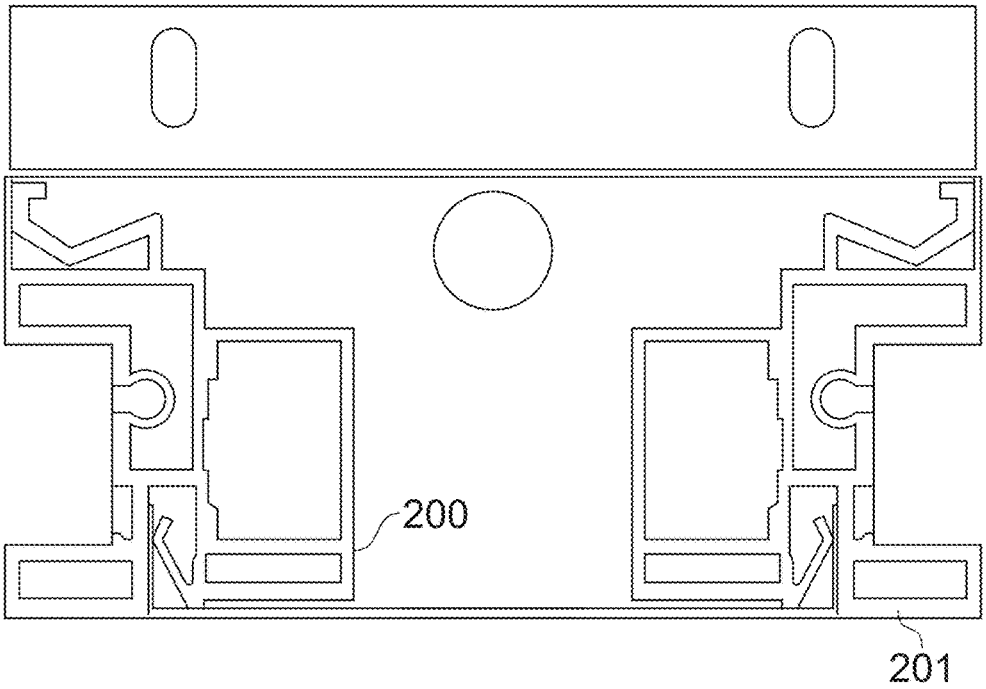
FIG. 2 (Prior Art)
FIG. 2 shows a cross section of a prior art support beam.

By filling the cavity with the filler 401 the outer shell 400 is stiffened and provided with advantageous thermal properties (reduced thermal conductivity) compared to the prior art plastic coated metal support shown in FIG. 2. Likewise, the foam core is protected by the hard outer shell 400. The two therefore exhibit a synergy to provide an effective support beam 310 that is light weight, has low thermal conductivity, and capable of supporting the structure of the refrigerator 300, shelving, and any contents attached thereto.

The outer shell 400 may further comprise fixtures to which shelving may be coupled (not shown), these are further discussed below in the second example.

Figure 5:
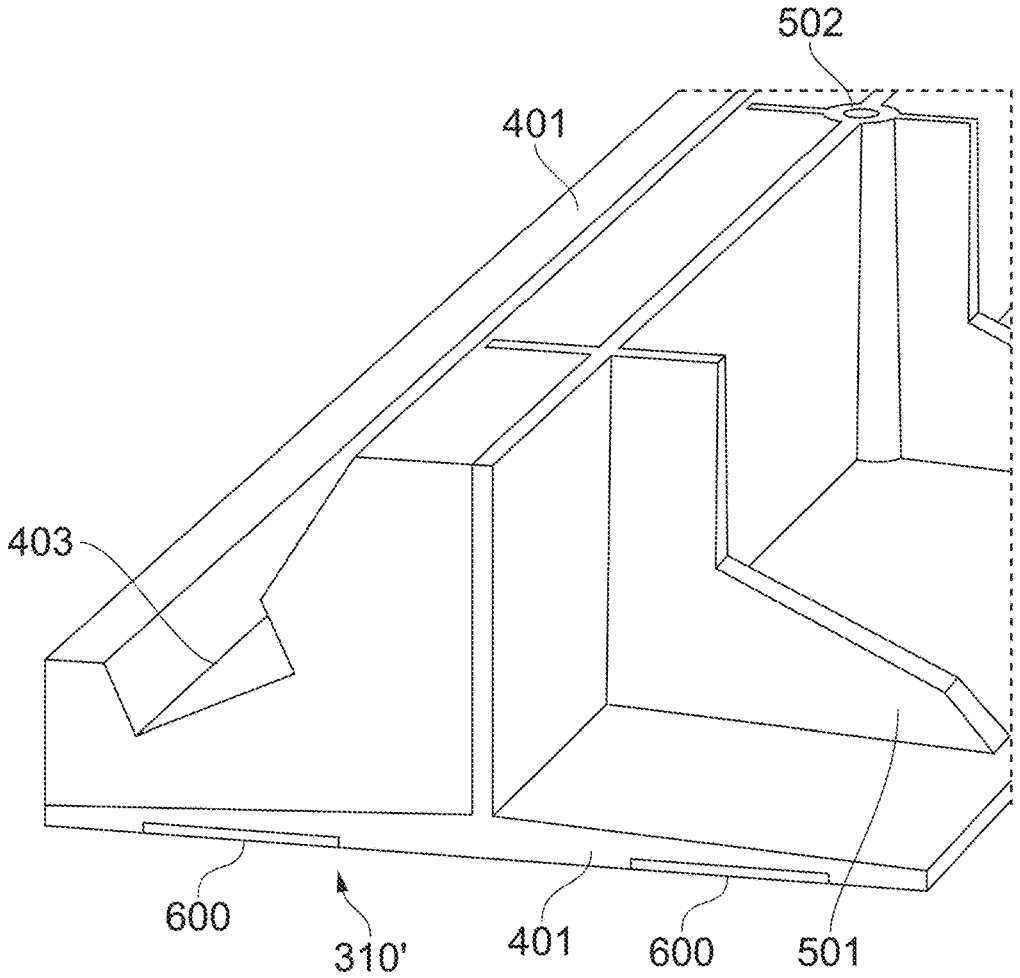
FIG. 5 shows a perspective view of a support beam according to the second example of the disclosure.

FIG. 5 shows an alternative second example support beam 310' compared the first example support beam 310. The support beam 310' comprises a rigid spine 500 of polypropylene having a keyed surface 501. The keying may be provided in the form of mechanical structures which a filler may grip and set around to thereby resist separation of the filler from the spine 500.

The spine 500 may further comprise fixtures 502 to which shelving may be coupled. Suitable fixtures 502 may be a blind aperture into which a finger of a shelf may be inserted, alternatively, the spine 500 may be provided with a ledge onto which a surface of a shelf may engage. To allow easy insertion of shelves a runner may be used to allow shelves to slide in and out of the refrigerator 300 or similar.

The filler 401 used is preferable a foam of the same or compatible material for the same reasons as those given for the first example of the disclosure. One suitable material is polypropylene. If the surface of the foam is exposed once applied to the spine 500 then a closed cell foam is preferably to avoid ingress of contaminants. Alternatively, a coating could be applied to an open cell foam to negate this issue.

The filler 401 in this example may be provided with a ancillary component mount 403 to receive an ancillary component, such as those discussed for the first example. The surface may be recessed as in the first example for the same reasons, and angled similarly to provide the same benefits.

The cross section of the second example is similar to that provided in the first example, and may vary as discussed previously. The substantially irregular hexagon comprising an elongate surface forms a jamb 402 suitable to receive one or more doors and likewise may provide a sealing surface to provide an air-tight seal with a door in the closed position.

Both first and second examples of the disclosure may be provided with means to urge 600 the door into the closed position, such as via magnetic strips (which may be magnets themselves or of a ferromagnetic material to attract a magnet arranged in a door). These may take the form of continuous strips running the main length of the support beams, along the jamb 402. Each jamb 402 may be provided with such a strip.

It will be appreciated by persons skilled in the art that the above detailed examples have been described by way of example only and not in any limitative sense, and that various alterations and modifications are possible without departing from the scope of the invention as defined by the appended claims. Various modifications to the detailed examples described above are possible.

Through the description and claims of this specification, the words “comprise” and “contain” and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract or drawings), or to any novel one, or any novel combination, of the steps of any method or process so disclosed.

It will be appreciated by persons skilled in the art that the above embodiment(s) have been described by way of example only and not in any limitative sense, and that various alterations and modifications are possible without departing from the scope of the invention as defined by the appended claims. Various modifications to the detailed designs as described above are possible.

The invention claimed is:

1. A support beam for a refrigerator, the support beam comprising:

an extruded outer shell defining a cavity, a filler foam occupying the cavity, at least one jamb, formed by the outer shell, wherein the filler foam is a polymer material and the extruded outer shell is also formed of the polymer material, wherein the extruded outer shell is a single extruded piece of the polymer material that defines a closing face for a door of the refrigerator.

2. A support beam for a refrigerator as claimed in claim 1 wherein the polymer material is polypropylene.

3. A support beam as claimed in claim 2 wherein the filler foam comprises expanded polypropylene.

4. A support beam as claimed in claim 1 wherein the support beam forms two jambs, each arranged to abut first and second respective doors.

5. A support beam as claimed in claim 4 wherein the two jambs are arranged on different regions of the support beam.

6. A support beam as claimed in claim 1 wherein the support beam is a barrier to thermal conductivity between the interior of a refrigerator and the exterior of a refrigerator.

7. A support beam as claimed in claim 1 wherein the closing face forms a door sealing surface.

8. A support beam as claimed in claim 1 wherein the support beam comprises an ancillary component mount formed in the filler or outer shell.

9. A support beam as claimed in claim 8, wherein an ancillary component is fixed to the ancillary component mount and is a light.

10. A support beam as claimed in claim 1 wherein the support beam further comprises means to urge a door in contact with the support beam towards the support beam.

11. A support beam as claimed in claim 1 wherein the support beam is capable of bearing the load of one or more refrigerator shelves and/or a refrigerator top panel.

12. A support beam as claimed in claim 1 wherein the support beam is provided with one or more accessible fixings to at least temporarily connect the support beam to the refrigerator.

13. A refrigerator comprising a support beam as claimed in claim 1.

14. A kit of parts comprising a support beam as claimed in claim 1.

* * * * *